US007541095B2

(12) United States Patent
Wu et al.

(10) Patent No.: US 7,541,095 B2
(45) Date of Patent: Jun. 2, 2009

(54) NON-CHROMIUM CONTAINING BLACK MULTI-LAYER COATINGS

(75) Inventors: Wan-Chu Wu, Kaohsiung (TW); Wei-Liang Yang, Hsinchu (TW); Wen-Chi Chang, Hsinchu (TW)

(73) Assignees: Elisha Holding LLC, Moberly, MO (US); Kismart Corporation, Taipei (TW)

( * ) Notice: Subject to any disclaimer, the term of this patent is extended or adjusted under 35 U.S.C. 154(b) by 0 days.

(21) Appl. No.: 11/925,319

(22) Filed: Oct. 26, 2007

(65) Prior Publication Data

US 2008/0102297 A1 May 1, 2008

Related U.S. Application Data

(60) Provisional application No. 60/855,095, filed on Oct. 27, 2006.

(51) Int. Cl.
*B32B 15/00* (2006.01)

(52) U.S. Cl. ..... 428/446; 428/632; 428/633; 428/680; 428/450

(58) Field of Classification Search ..... 428/632, 428/633, 639, 680, 641, 446, 450
See application file for complete search history.

(56) References Cited

U.S. PATENT DOCUMENTS 5,023,146 A * 6/1991 Saito et al. ..... 428/623
6,376,022 B1 4/2002 Mallow et al.
2006/0228569 A1 10/2006 Kojima et al.

FOREIGN PATENT DOCUMENTS

WO 03/021009 3/2003

OTHER PUBLICATIONS

International Search Report from corresponding International Application No. PCT/US 07/82693, mailed Mar. 6, 2008.
Written Opinion from corresponding International Application No. PCT/US 07/82693, mailed Mar. 6, 2008.

* cited by examiner

*Primary Examiner*—Timothy M Speer
(74) *Attorney, Agent, or Firm*—Polster, Lieder, Woodruff & Lucchesi, L.C.

(57) ABSTRACT

The disclosed invention relates to black multi-layer coatings for metallic substrates (1) or substrates having a metallic coating (2) and to articles covered, or partially covered with such coatings. The black coating consists of a black first layer (3) substantially comprised of nickel and a second polymeric silicate inorganic layer (4). The present invention may additionally have a third layer comprised substantially of organic constituents (5). This invention offers properties currently unavailable or insufficient in existing technologies. The present invention provides enhanced corrosion resistant, adherent black coatings which are thin enough to allow application to fasteners while providing a uniform black color, the combination of which have only been available previously with the use of hexavalent or trivalent chromium conversion coatings.

25 Claims, 1 Drawing Sheet

1: Metallic/Conductive Substrate
2: Metallic Coating
3: Blackened Layer
4: Polymeric Silicate Inorganic Layer
5: Organic Sealer Layer 1: Metallic/Conductive Substrate 2: Metallic Coating 3: Blackened Layer 4: Polymeric Silicate Inorganic Layer 5: Organic Sealer Layer

NON-CHROMIUM CONTAINING BLACK MULTI-LAYER COATINGS

CROSS-REFERENCE TO RELATED APPLICATIONS

This application derives and claims priority from U.S. provisional application Ser. No. 60/855,095 filed Oct. 27, 2006, which is incorporated herein by reference.

STATEMENT REGARDING FEDERALLY SPONSORED RESEARCH OR DEVELOPMENT

Not Applicable.

TECHNICAL FIELD

The instant invention relates to a multi-layer, corrosion resistant coating system on the surface of a metallic or conductive substrate and articles containing the inventive coating system. The invention is especially beneficial for fasteners, hinges, latches, rivets and other hardware in the areas of automotive, furniture, construction, and electronics among other areas.

BACKGROUND ART

There are many methods known to the art to produce an article with a black appearance. These methods include black organic coatings, black phosphate conversion coatings, black oxide chemical treatments, black hexavalent and trivalent chromium passivation conversion coatings, black nickel deposition coatings, and heat (thermal) treatments. The heat treatments may be achieved by exposure to both gaseous atmospheres and molten salt treatments but have the disadvantage that their use is primarily tailored to obtain physical characteristics within the substrate material, however the corrosion resistance is often insufficient and applicability is limited to specific metal alloys.

Several types of phosphate conversion coatings are available, however, those based on zinc, manganese, or zinc-manganese or modifications of those produce a heavier film with a darker, more uniform appearance. These coatings are generally non-metallic and crystalline in form and have limited corrosion resistance without application of subsequent inhibitor, oil, wax, or polymeric coatings.

The use of black chromate conversion coatings, particularly of the hexavalent type, has been discouraged and in some places banned altogether. A further disadvantage of hexavalent chromate films is the significant decline in corrosion resistance occurring when the films are exposed to temperatures above approximately 75 C. The performance of trivalent black chromate conversion coatings has thus far been inconsistent and too expensive for some applications. Black oxide treatments and chromium passivation treatments may additionally include the use of black dyes. Black nickel coatings are well known for decorative applications but heretofore have not typically been utilized for applications requiring corrosion resistance.

Organic coatings may be applied via spray, immersion (dip-drain and dip-spin), and brush application. Immersion coatings include E-Coat applications (electrolytic deposition) and autodeposition applications (also known as autophoretic, i.e. catalytically deposited coatings). Spray application includes powder coating which is an electrostatic deposition as well as liquid paint propelled with compressed air or other propellants. The organic coatings are cured by use of numerous techniques which include coalescence upon evaporation of water or other solvent, thermal curing, reactive curing (moisture, UV/Radiation, chemical cross-linkers, etc.). The most significant drawback of the aforementioned commercially available black surface treatments is that, with exception to the chromate treatments, they provide either insufficient corrosion resistance, excessively thick polymer layers, or their appearance is non-uniform due to article to article contact during their treatment process. The non-uniform appearance can be overcome with successive coating layers such as in the case of organic coatings, however, the resulting excessive thickness cannot be tolerated on fasteners with fine threads or other articles with critical dimensions.

Various treatments, which incorporate silicon, are also well known in industry. These treatments may be of the form where silicon is contained in an organic molecule such as of the silane type (e.g. aminosilanes and epoxy silanes) or organosilicate type (e.g. tetraethyl ortho silicate), organic polymers (e.g. silicone resins), and inorganic silicates and silicas. However, with exception to the silicone resins which generally result in a coating that is too thick for fasteners, the films and surface treatments consisting of various silicon containing materials does not effectively produce a uniform black coating. Applicability of electrolytic deposition of silicate thin films has been limited to electrically conducive metallic substrates. There is a need in this art for a black non-chromate that is obtained from environmentally acceptable materials.

BRIEF SUMMARY OF THE INVENTION

The instant invention solves problems associated with conventional materials by providing a corrosion resistant coating system that employs environmentally acceptable materials and demonstrates enhanced resistance to heat. The instant invention relates to a black multi-layer coating for metallic substrates or substrates having a metallic coating and to articles covered, or partially covered with such coatings. The terms "black" or "darkened" are used interchangeably herein and refer to the appearance of the coating upon the substrate as being relatively black or dark in comparison to the substrate prior to applying the inventive coating. The terms "chrome-free" or "non-chromium" refer to substantial absence of chromium and chromates from the coating. By substantial absence it is meant that the coating contains less than about 0.1% by weight chromium or chromate compounds. The substrate coated by the inventive system may contain chromium or chromate compounds, for example, certain chromium steel or stainless steel substrates can be coated by the inventive non-chromium coatings.

The inventive black coating comprises a semi-metallic black first layer comprised of nickel, sulfur, and various oxides/hydroxides and a second layer comprising a polymeric inorganic silicate. The first layer is normally in contact with the substrate with the second layer either directly or indirectly overlying the first. Both layers may additionally contain modifying elements for the purpose of promoting specific attributes. The present invention may additionally have a third layer comprised substantially of organic constituents comprising a topcoat or sealer.

DETAILED DESCRIPTION OF THE INVENTION

Figure 1:
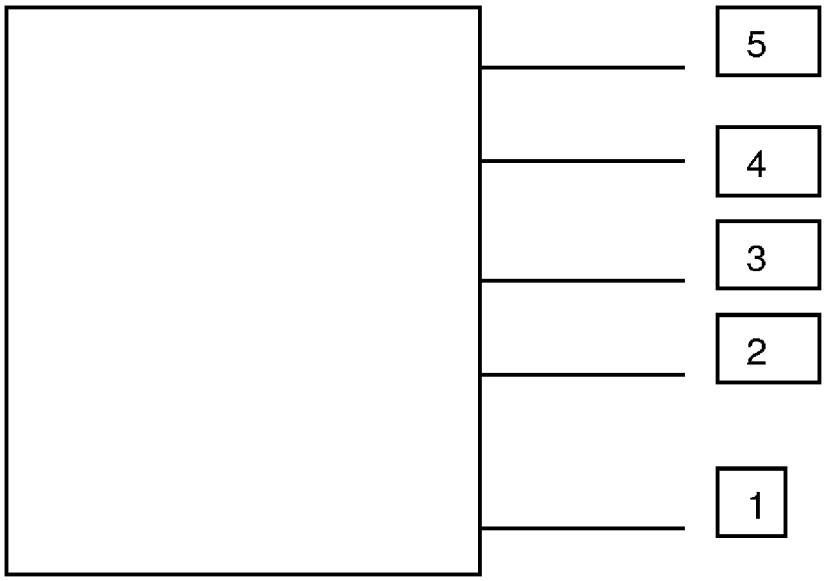
FIG. 1 is a schematic representation of the inventive coating system.

The inventive coating system can be applied onto a wide range of substrates including zinc and zinc alloys (e.g., zinc-iron, zinc-nickel, tin-zinc, among other zinc alloys). The zinc and zinc alloy substrates are typically plated (e.g., electrically or mechanically), onto an iron or iron alloy article (e.g., steel).

The inventive coating system is obtained by depositing at least two coatings, films or layers upon the zinc substrate. A black nickel coating is deposited as the first layer of the inventive coating system. The amount of nickel present ranges from about 1 to about 60% by weight and normally from about 1.5 to about 40% by weight (e.g., from about 2 to about 20% by weight). The first layer can also contain an amount of sulfur that ranges from about 0.1 to about 20% by weight and typically from about 0.4 to about 10% by weight (e.g., from about 1 to about 5% by weight). A major portion (59-94 atomic %) of this layer is represented by non-metallic compounds (primarily oxides and hydroxides) of nickel, and sulfur; best characterized as a semi-metallic layer. Additionally, the black coating layer may contain at least one modifying element, such as zinc or phosphorous, present in elemental form or as a substantially insoluble oxide, hydroxide, carbonate, or sulfate. Additionally, the black coating layer may contain organic constituents such as wetting agents, surfactants, dispersed polymers, waxes, etc. which serve to improve uniformity of the deposit, add gloss to the appearance, and improve corrosion resistance. The carbon elemental composition resulting from such additions can range up to 75 weight percent. The thickness of the black layer should range from 0.1-2.5 microns to achieve a uniformly dark appearance, however, it is anticipated that a thicker film may have advantages for specific applications. The first or black layer can be deposited by any suitable method such as those described by Itoh in U.S. Pat. No. 5,718,745; hereby incorporated by reference.

The second layer of the inventive system comprises at least one inorganic silicate polymer. The silicate polymer comprises from about 30 to about 50 weight % silicon and typically from about 35 to about 45% by weight (e.g., from about 38 to about 42% by weight silicon). The silicate polymer can comprise from 50 to 70% by weight oxygen and typically from 55 to 65% by weight oxygen (e.g., from 58 to 62% by weight oxygen). Additionally, the silicate polymer layer may further comprise at least 1 modifying element, such as aluminum, magnesium, or calcium; present as a substantially insoluble oxide, hydroxide, carbonate, sulfate, or silicate as well as silica compounds. The inorganic silicate polymer layer typically ranges in thickness from 0.1 to 0.2 microns, however, it is anticipated that a thicker film may have advantages for specific applications. The silicate polymer layer can be formed by any suitable method such as those described in U.S. Pat. Nos. 6,149,794; 6,258,243; 6,153,080; 6,322,687; 6,572,756B2; 6,592,738B2; 6,599,643; 6,761,934; 6,753,039; 6,866,896B2; and U.S. application Ser. Nos. 10/211,094; 10/713,480; 10/831,581 and 10/636,904. The disclosure of the foregoing patents and patent applications is hereby incorporated by reference. The methods taught in the foregoing patents and patent applications demonstrate applicability to conductive metal substrates. Therefore, the enhanced corrosion resistance of the present invention obtained by combination of an inorganic silicate second layer over a semi-metallic black first layer is unexpected and reveals a novel feature further demonstrated in the examples.

Optionally, the black nickel coating with the silicate film may be further coated with a sealer or topcoat to further enhance the properties of the coated article. Aqueous sealers known to the art may be employed to further enhance corrosion resistance, appearance, durability, and lubricity, among other properties. Such sealers may include but are not limited to vinyl acrylics, water dispersible urethanes containing at least one silicate (U.S. Patent No. 5,861,668 hereby incorporated by reference), Aqualac®°, or JS 500™ (MacDermid Corp), Enseal® or Microseal® (Enthone Corp), Plus™ or Plus L™ (Metal Coatings International), Techniseal 440 ® (New Surface Technologies), Briteguard® RP90(A-Brite Company), Corrosil® Plus 501 BG (Atotech), and Agate® lacquers (Agate manufacturing company). Topcoats may include, but are not limited to epoxies (liquid and powder-coat resins such as those supplied by Magni® or Morton Corvel®). acrylic latexes, polyurethanes, silicones, and polyester powder-coat resins, among others.

Thickness of the sealer layer can range from 0.5 to 3.0 microns and typical topcoat layers can 3.0 to 15 microns for fasteners and as much as 76-100 microns for large articles in outdoor environments.

The total thickness of the present invention can range from 0.3-2.5 microns if no sealer or topcoat is used or 0.7-5.7 microns with a sealer layer and is suitable for use on threaded fasteners. The total thickness for articles treated with this invention and provided with a polymeric topcoat can range from 5.7 to over 100 microns.

Referring now to the drawing, FIG. 1 is a schematic representation of one aspect of the inventive coating system. FIG. 1 illustrates a black multi-layer coating for metallic substrates (1) or substrates having a metallic coating (2). The black coating comprises a black first layer (3) comprising nickel and a second polymeric silicate inorganic layer (4). The present invention may additionally have a third layer comprising organic constituents (5).

The following Examples are provided to illustrate certain aspects of the invention and do not limit the scope of any claims appended hereto.

EXAMPLES

Example 1

Zinc plated automobile screws measuring about 11 mm (head diameter)×6 mm (thread diameter)×18 mm (overall length) were coated with the subject invention. The coated screws were analyzed by using a JEOL JSM-6500F Scanning Electron Microscopy with Energy Dispersive X-Ray Analysis (SEM-EDS) in accordance with conventional methods, and the following composition ranges were detected:

| ELEMENT | MINIMUM ATOMIC % | MAXIMUM ATOMIC % |
|---|---|---|
| Carbon | 15 | 60 |
| Oxygen | 20 | 53 |
| Silicon | 1 | 14 |
| Phosphorous | 0.5 | 1.0 |
| Sulfur | 0.1 | 7 |
| Nickel | 0.4 | 10 |
| Zinc | 5 | 30 |

Due to the relatively thin characteristics of the coating system, the elemental results represent a composite of the two coating layers as well as a contribution from the substrate layer (zinc plating). Note that 59-94 of the atomic % is represented by non-metallic constituents, signifying a semi-metallic blackened layer composition. The composition can be attributed to the following layered structure:

| ELEMENT | MINIMUM ATOMIC % | MAXIMUM ATOMIC % |
|---|---|---|
| Silicate Layer | | |
| Silicon | 20.0 | 33.3 |
| Oxygen | 66.7 | 80.0 |
| Black Layer | | |
| Carbon | 53.6 | 58.3 |
| Oxygen | 24.3 | 42.9 |
| Phosphorous | 1.0 | 1.8 |

-continued

| ELEMENT | MINIMUM ATOMIC % | MAXIMUM ATOMIC % |
|---|---|---|
| Nickel | 1.4 | 9.7 |
| Sulfur | 0.4 | 6.8 |
| Substrate | | |
| Zinc | 95 | 100 |

Example 2

Salt spray corrosion testing (ASTM-B117) was performed on rivet samples of the present invention and compared with zinc phosphate coated rivet samples as well as zinc phosphate coated rivet samples in which an attempt was made to apply the silicate layer of the present invention with the following results:

| Coating System | Number Of Samples | Average Time To Red Corrosion (Hours) |
|---|---|---|
| Zinc Plate With Blackened Layer | 12 | 62 |
| Zinc Plate With Blackened Layer & Silicate Layer | 12 | 340 |
| Zinc Phosphate | 12 | <6 |
| Zinc Phosphate & Silicate | 12 | <6 |

The zinc phosphate composition typically consists of the following elemental composition: Zinc (15-23 atomic %), Iron (1-8 atomic %), Phosphorous (13-18 atomic %), and Oxygen (55-65 atomic %), as well as other minor constituents. The zinc phosphate composition is typically arranged in a crystalline, non-metallic orientation. This example demonstrates that the silicate layer is effective in conjunction with the semi-metallic layer of the present invention.

Example 3

Sample rivets with a coating of the present invention were subjected to 4 hours of thermal exposure in a standard convection oven at temperatures provided below and subsequently subjected to salt spray corrosion testing. Samples from the same zinc plating batch were given a commercially available black hexavalent chromate conversion coating and subjected to the thermal treatment at the same time as the corresponding samples of the present invention and then subjected to salt spray corrosion testing also at the same time. The results are as follows:

| | Salt Spray Test Hours To Red Corrosion (Average) | |
|---|---|---|
| Thermal Treatment Temperature (° C.) | Present Invention | Black Hexavalent Chromate |
| None | 340 | 428 |
| 75 | 308 | 282 |
| 100 | 256 | 122 |
| 125 | 320 | 114 |
| 150 | 206 | 106 |
| 175 | 248 | 100 |
| 200 | 154 | 100 |

Examination of the above results reveals a well-known weakness of hexavalent chromate treatments, a significant reduction in performance at elevated temperatures. This example demonstrates that the inventive coating system has stable corrosion resistance in conditions where heating between 75 and 200° C. occurs.

Example 4

Standard zinc plated auto screws (M8×65 mm) were coated with the present invention and additionally provided with a black polymeric sealer layer. The polymeric sealer layer was comprised of 78.7% by weight of a polymer blend based on bisphenol-A type epoxy resin and n-butylated urea-melamine formaldehyde resin (3.7:1 weight ratio), 8% by weight aniline black colorant, and 13.3% by weight polytertrafluoroethylene wax. The thickness of the sealer layer was about 3 microns. Six of the coated screws were subjected to salt spray testing and white corrosion products occurred at an average of 188 hours. The first occurrence of red corrosion products was 1248 hours.

We claim:

1. A coating for application upon a metallic substrate; the coating being a multi-layer coating system comprising: (a) a first layer which is deposited on the substrate and which comprises nickel, sulfur and at least one member selected from the group consisting of nickel oxide, nickel hydroxide, sulfur oxide and sulfur hydroxide and (b) a second layer which directly or indirectly overlays the first layer and comprises an inorganic silicate polymer comprised of silicon and oxygen.

2. The coating of claim 1, where the amount of nickel present ranges from about 1 to about 60% by weight of the first layer.

3. The coating of claim 1, where the amount of sulfur present ranges from about 0.1 to about 20% by weight of the first layer.

4. The coating of claim 1, where the inorganic silicate polymer comprises from about 30 to about 50% by weight silicon.

5. The coating of claim 1, where the inorganic silicate polymer comprises from about 50 to about 70% by weight oxygen.

6. The coating of claim 1, wherein the first layer further comprises phosphorous in the form of phosphate; the phosphorous comprising up to about 2% by weight of the first layer.

7. The coating of claim 1, wherein the first layer further comprises at least one modifying element present in elemental form or as a substantially insoluble oxide, hydroxide, carbonate, or sulfate.

8. The coating of claim 7, in which the modifying element comprises zinc.

9. The coating of claim 1, further including organic additives in the first layer; the organic additives including wetting agents, surfactants, waxes and/or dispersed polymers.

10. The coating of claim 9, wherein up to and including 75 weight % of the first layer is due to carbon in the organic additives.

11. The coating of claim 1, further comprising a third outermost layer of at least one member selected from the group consisting of organic polymers, monomers, oligomers, or a combination thereof.

12. The coating of claim 1, wherein the first layer is black in color.

13. An article having a metallic surface with a multi-layer coating on the surface; the coating comprising:

a. a first layer comprising nickel, sulfur and at least one member selected from the group consisting of nickel oxide, nickel hydroxide, sulfur oxide and sulfur hydroxide and b. a second layer which directly or indirectly overlays the first layer and comprises an inorganic silicate polymer comprised of silicon and oxygen.

14. The article of claim 13, where the amount of nickel present ranges from about 1 to about 60% by weight of the first layer.

15. The article of claim 13, where the amount of sulfur present ranges from about 0.1 to about 20% by weight of the first layer.

16. The article of claim 13, where the inorganic silicate polymer comprises from about 30 to about 50% by weight silicon.

17. The article of claim 13, where the inorganic silicate polymer comprises from about 50 to about 70% by weight oxygen.

18. The article of claim 13, wherein the first layer further comprises phosphorous in the form of phosphate; the phosphorous comprising up to about 2% by weight of the first layer.

19. The article of claim 13, wherein the first layer further comprises at least one modifying element present in elemental form or as a substantially insoluble oxide, hydroxide, carbonate, or sulfate.

20. The article of claim 19, in which the modifying element comprises zinc.

21. The article of claim 13, further including organic additives in the first layer including wetting agents, surfactants, waxes and/or dispersed polymers.

22. The article of claim 21, wherein up to and including 75 weight % of the first layer is due to carbon in the organic additives.

23. The article of claim 13, further comprising a third outermost layer of at least one member selected from the group consisting of organic polymers, monomers, oligomers, or a combination thereof.

24. The article of claim 13, wherein the first layer of the coating is black in color.

25. The article of claim 13, wherein the surface is a zinc or zinc alloy surface.

* * * * *